United States Patent [19]

Herrmann, Jr. et al.

[11] 4,018,977

[45] Apr. 19, 1977

[54] HIGH VOLTAGE CABLE WITH AIR DIELECTRIC

[75] Inventors: Henry Otto Herrmann, Jr., Mount Joy; Douglas Wade Glover, Harrisburg, both of Pa.

[73] Assignee: AMP Incorporated, Harrisburg, Pa.

[22] Filed: July 2, 1976

[21] Appl. No.: 702,266

Related U.S. Application Data

[63] Continuation-in-part of Ser. No. 601,700, Aug. 4, 1975, abandoned.

[52] U.S. Cl. ..... 174/24; 174/29

[51] Int. Cl.[2] ..... H01B 7/02

[58] Field of Search ..... 174/16 B, 24, 28, 29

[56] References Cited

UNITED STATES PATENTS

| | | | |
|---|---|---|---|
| 2,461,834 | 2/1949 | Morin | 174/29 |
| 2,599,857 | 6/1952 | Mildner | 174/29 |
| 3,685,147 | 8/1972 | Nevin et al. | 174/29 X |

*Primary Examiner*—Arthur T. Grimley
*Attorney, Agent, or Firm*—Gerald K. Kita

[57] ABSTRACT

The present invention relates to a high voltage cable having a composite dielectric of solid insulation surrounded by an air dielectric. Spacers extend from the solid dielectric and through the air dielectric to maintain a dust cover in radially spaced relationship from the solid insulation and to define the air dielectric diameter.

8 Claims, 4 Drawing Figures

HIGH VOLTAGE CABLE WITH AIR DIELECTRIC

CROSS REFERENCE TO RELATED APPLICATION

This application is a continuation-in-part application of Ser. No. 601,700, filed Aug. 4, 1975 now abandoned.

FIELD OF THE INVENTION

The present invention relates to a high voltage electrical cable and more particularly to a high voltage cable advantageously utilizing air as a dielectric enabling the cable to be low in cost, flexible and readily manufacturable.

BACKGROUND OF THE PRIOR ART

A cable carrying high voltages must be designed to operate without voltage breakdown stress in the cable insulation and without corona externally of the cable insulation.

The possibility of breakdown stress of the insulation occurs at the surface adjacent the conductor. Increasing the conductor diameter reduces the voltage stress applied to the insulation adjacent the conductor. However, the cost of the cable increases with the diameter of the conductor. It is also expensive but desirable to utilize a conductor as cylindrical as possible so that its effective diameter predictably operates without undue voltage stress concentrations. One economizing approach is to fabricate a conductor of stranded leads and extrude thereover a jacket of semiconductive, or high resistance, dielectric material such as carbon impregnated polyethylene. This results in a composite conductor of inexpensive material having an even cylindrical shape and relatively large diameter. Insulation can then be intimately bonded to the composite conductor to exclude deleterious air pockets.

Elimination of corona externally of the cable has been heretofore prevented by fabricating the cable insulation to a relatively large diameter. Such practice has resulted in very stiff cable having expensive and consequently expensive amounts of insulation. Reducing the insulation diameter by using a more effective dielectric has not been satisfactory due to increased costs of the better dielectric and its inherent stiffness.

Another drawback of solid insulated high voltage cable is a requirement to exclude air. Any damage to the cable insulation allows air leakage toward the conductor, increasing the chance of corona externally of the cable. Thus protection of the cable insulation has heretofore been required by providing a tough jacket thereover, further adding to stiffness.

SUMMARY OF THE INVENTION

The present invention is a high voltage cable having a composite dielectric in which unpressurized air is utilized advantageously. This eliminates the need for a tough jacket or other heavy damage protection cover. The composite dielectric can withstand surprising amounts of damage since the receipt of air therein does not reduce the insulation effect. Stiffness of the cable is reduced to tolerable limits. The cable is thereby flexible, low in cost and is also readily manufacturable. The cable takes the form of a center conductor having an intimate jacket of solid dielectric. Encircling the solid dielectric is a dielectric of unpressurized air. Stiffness of the cable is thereby reduced to that stiffness of the conductor and its solid dielectric. An outer dust cover of inexpensive flexible air permeable material such as polyester cloth prevents dust of lesser dielectric value than air from entering the air dielectric. Spacers of inexpensive dielectric, preferably having a dielectric constant approximate that of air, retains the cover in radially spaced relationship and also defines the air dielectric radial dimension. The spacers can be unitary with the solid dielectric. Alternatively the spacers can be of a form to be assembled over the solid dielectric.

OBJECTS

Accordingly an object of the present invention is to provide a high voltage cable which is flexible and which is low in cost.

Another object is to provide a high voltage cable with a composite dielectric advantageously utilizing air as one of the components.

Another object is to provide a high voltage cable which eliminates the need for a protective jacket for the insulation and which utilizes a flexible low cost dust cover to protect a composite dielectric.

Another object is to provide a high voltage cable having a composite dielectric of solid insulation and air dielectric together with spacers extending through the air dielectric to define the radial dimension of the air dielectric and to maintain a dust cover for the cable in radially spaced relationship.

DETAILED DESCRIPTION

Figure 1:
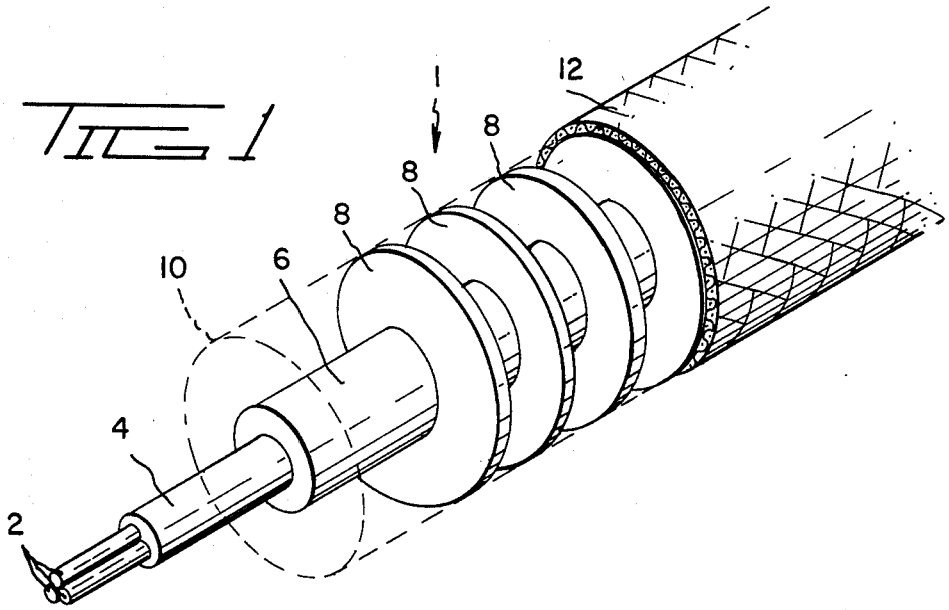
FIG. 1 is a fragmentary enlarged perspective with parts broken away of a preferred embodiment of the high voltage cable according to the present invention.
Figure 2:
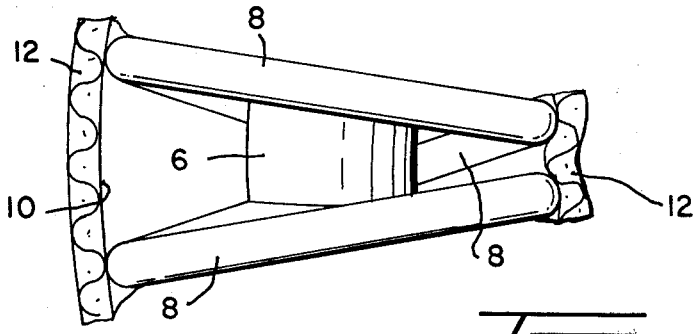
FIG. 2 is an enlarged fragmentary plan of a portion of the preferred embodiment shown in FIG. 1.

As shown more particularly in FIGS. 1 and 2, a high voltage electric cable 1 includes a composite primary conductor having a plurality of adjacent strands of wire 2 such as copper intimately encased within an extruded layer of cylindrical semiconductive or high resistant polyethylene 4. The strands 2 and polyethylene 4 thus comprise a cylindrical conductor of relatively inexpensive material and having a desirably enlarged and desirably cylindrical outer surface. Bonded to the cylindrical polyethylene 4 is an extruded cylindrical layer of a suitable solid dielectric 6. The insulation 6 is provided with a projecting dielectric flange 8. The flange 8 defines a series of helical spacers which are continuously serially joined and which project generally radially from the solid insulation 6 to define an air dielectric 10 of generally cylindrical length coaxially with the solid insulation 6 and with the conductor 4. The spacers defined by the helical flange 8 thereby define the outer radial dimensions of the air dielectric 10. Additionally, a cylindrical jacket 12 is maintained in radially spaced relationship by the spacers defined by the flange 8. The cover 12 is air permeable but impervious to dust particles. The cover thus provides a dust cover for the cable and prevents particles having dielectric constants less than that of air from entering the air dielectric. As shown in FIG. 2, the resulting cable is extremely flexible. The series of helical spacers 8 are readily tilted to accommodate bending of the cable about a radius. The air dielectric 10 does not add to the stiffness of the cable. Consequently the cable stiffness is reduced to tolerable limits and is equal to the stiffness of the composite conductor and the solid insulation 6. The dust cover 12 is fabricated from a light flexible material such as polyester cloth for example, which is readily deformable to allow flexing of the cable about a radius. In addition the dust cover 12 need not be intimately joined to the spacers provided by the flange 8. Such a feature allows slipping of the flange 8 within the confines of the jacket 12 further reducing stiffness in the cable as it is bent about a radius. A suitable material for the solid insulation 6 was found to be polyethylene. The flange 8 was also found suitable if made from polyethylene which as a dielectric constant approximating that of the air dielectric 10 such that the presence of the spacers with the air dielectric 10 does not provide a substantial change in the effective insulation effect surrounding the solid insulation 6. The cable 1 except for the jacket or cover 12 can be relatively fabricated by extrusion. First the conductor layer 4, followed by extrusion of the solid insulation 6 unitary with the helical series of spacers defined by flange 8 according to well known extrusion techniques. In addition the series of spacers can be fabricated separately if desired and assembled over the solid insulation 6 and bonded thereto with an adhesive. This is advantageous when they are fabricated of an air entrained dielectric foam as as alternative material. The series of spacers may also have other shapes than helical, such as annular rings in spaced relationship if desired.

Figure 3:
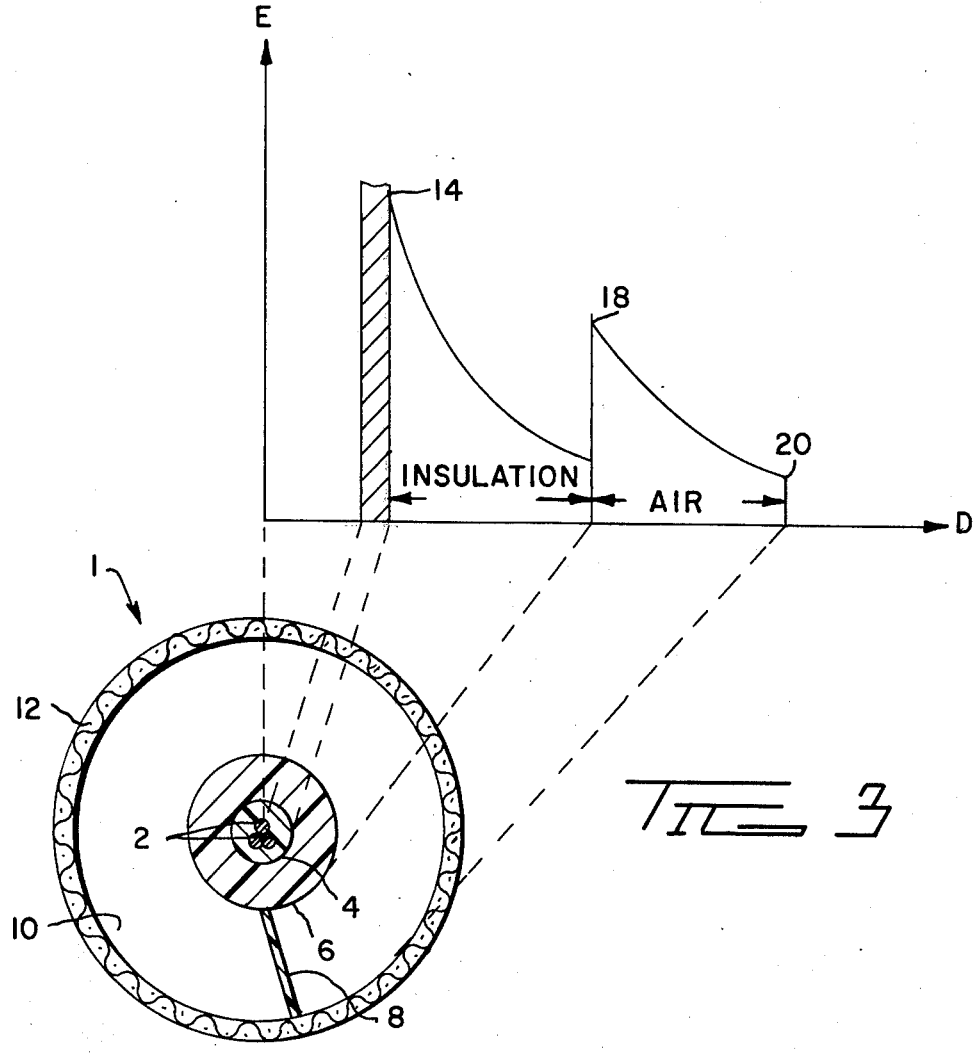
FIG. 3 is a graphical representation of the insulation effect of the preferred embodiment as shown in FIG. 1.

As shown in FIG. 3 a cross-section of the cable 1 is shown impressed upon a graph of voltage stress E versus distance D away from the central axis of the cable. As shown the highest voltage stress 14 occurs at the surface of the conductor 4. The insulation 6 reduces the voltage gradient logarithmically as distance from the center axis increases. At point 16, where the air dielectric begins, the voltage stress increases to a point 18 at the surface of the solid dielectric 6. The magnitude of the voltage stress at point 18 is less than the breakdown voltage stress of air. The air dielectric then reduces the voltage stress from point 18 logarithmically to a magnitude indicated at 20 which will be insufficient to support corona at the external surface of the cable. It is noted that the presence of the dielectric spacers 8 do not substantially effect the reduction in voltage stress in the air dielectric provided that the dielectric constant approximates that of air itself. It is further advantageous that any damage or puncturing of the spacers 8 or of the cover 12 will not provide leakage paths sufficient to support corona because the magnitude of the voltage stress 20 will not be disturbed by receipt of air admitted by the damaged cover 12 or spacers 8. Accordingly the stress voltage reduction from points 18 to 20 is not at all affected by damage to the cable occurring at those distances from the center axis of the cable.

Figure 4:
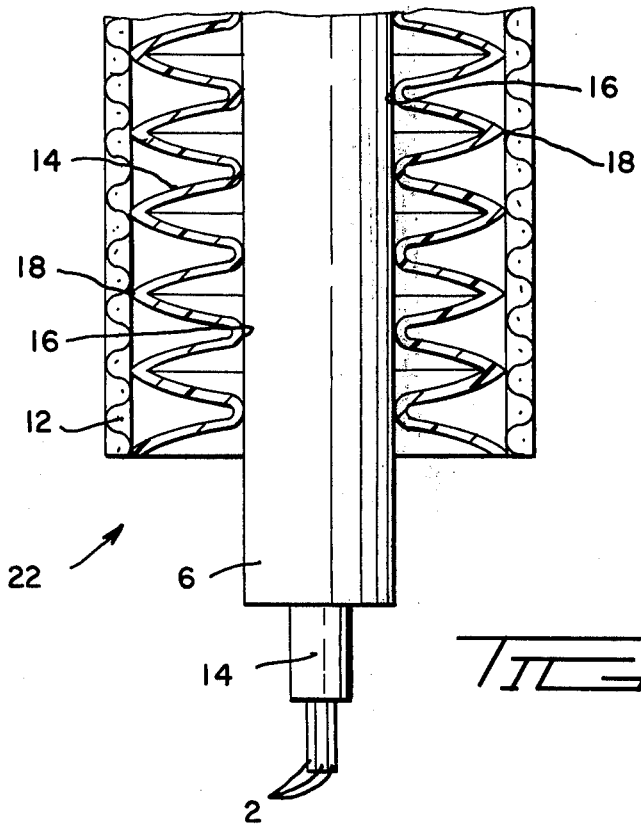
FIG. 4 is an enlarged fragmentary longitudinal section of another preferred embodiment of the present invention.

FIG. 4 illustrates another preferred embodiment of the cable. Such preferred embodiment illustrated at 22 generally includes the center strands 2, the semiconductive dielectric 4, the solid dielectric 6 and the outer dust cover 12 of the previous embodiment. In this embodiment however the dielectric flange 8 defining the spacers are replaced by a continuous bellows 24 of polyethylene, solid dielectric or an air entrained foam dielectric. The bellows 24 is fabricated according to well known techniques such that the inner diameters 26 of the bellows convolutions impinge in encirclement around the solid insulation 6. Similarly the outer diameter portions 18 of the bellows convolutions impinge radially outward against the cover or jacket 12. The inner diameter portion 26 may be bonded to the surface of the solid insulation 6. Alternatively the insulation 6 may be held in place merely by friction within the bellows inner diameter portions 26. The outer diameter portions 28 of the bellows also may be bonded to the cover 12. Even when bonded, the bellows convolutions will flex to allow bending of the cable about a radius. The flexible cover 12 will readily flex as in the previous embodiment to allow such bending. Accordingly the bellows and jacket even though bonded together do not add substantially to the stiffness of the cable 22.

What has been described and shown are preferred embodiments of the present invention. It is to be understood that other embodiments and modifications thereof apparent to one having ordinary skill in the art are intended to be covered by the spirit and scope of the appended claims.

What is claimed is:

1. A high voltage cable, comprising:

a center conductor, a layer of solid insulation encircling said conductor, a cover of air permeable flexible material enclosing said layer of solid insulation, said cover being impervious to dust particles and defining a dust free unpressurized air space around said solid insulation, and spacer means between said solid insulation and said cover defining the outer radial extent of said air space.

2. The structure as recited in claim 1, wherein, said cover comprises a cloth of polyester material.

3. The structure as recited in claim 1, wherein, said spacer means comprises a material having a dielectric constant approximating that of air.

4. The structure as recited in claim 1, wherein, said spacer means comprises a series of flanges of a solid dielectric material approximating that of air.

5. The structure as recited in claim 4, wherein, said flanges are annular.

6. The structure as recited in claim 4, wherein, said flanges are helical and are serially joined to provide a continuous helical flange.

7. The structure as recited in claim 4, wherein, said spacer means comprises a bellows having a series of convolutions, with the inner diameters of said convolutions impinging in encirclement against said solid insulation, and with the outer diameters of said convolutions impinging against said cover.

8. The structure as recited in claim 7, wherein, the outer diameters of said convolutions are bonded to said cover.

* * * * *